US008739755B2

(12) United States Patent
Stan et al.

(10) Patent No.: US 8,739,755 B2
(45) Date of Patent: Jun. 3, 2014

(54) PISTON FOR AN INTERNAL COMBUSTION ENGINE

(75) Inventors: Sorin Stan, Farmington Hills, MI (US); Michael T. Lapp, Bloomfield, MI (US); Tony Daivd Cimbalik, Peoria, IL (US)

(73) Assignee: Mahle International GmbH (DE)

( * ) Notice: Subject to any disclaimer, the term of this patent is extended or adjusted under 35 U.S.C. 154(b) by 200 days.

(21) Appl. No.: 13/279,671

(22) Filed: Oct. 24, 2011

(65) Prior Publication Data

US 2013/0098316 A1 Apr. 25, 2013

(51) Int. Cl.
*F01P 3/06* (2006.01)

(52) U.S. Cl.
USPC ..... 123/193.6; 123/41.35

(58) Field of Classification Search
USPC ..... 123/193.6, 41.35; 92/187
See application file for complete search history.

(56) References Cited

U.S. PATENT DOCUMENTS

| | | | | |
|---|---|---|---|---|
| 4,180,027 | A | 12/1979 | Taylor | |
| 6,491,013 | B1 | 12/2002 | Gaiser et al. | |
| 6,920,860 | B2 * | 7/2005 | Gabriel et al. | 123/193.6 |
| 2008/0314240 | A1 | 12/2008 | Walker et al. | |
| 2011/0265743 | A1 * | 11/2011 | Ask et al. | 123/41.35 |
| 2012/0222644 | A1 * | 9/2012 | Bing et al. | 123/193.6 |

FOREIGN PATENT DOCUMENTS

| | | | |
|---|---|---|---|
| DE | 1955903 | A1 | 5/1970 |
| DE | 10132446 | A1 | 1/2003 |
| FR | 2839116 | A1 | 10/2003 |
| JP | 2301648 | A | 12/1990 |
| WO | WO-2010/009779 | A1 | 1/2010 |

OTHER PUBLICATIONS

International Search Report, PCT/US2012/061461, dated Feb. 7, 2013.

* cited by examiner

*Primary Examiner* — Marguerite McMahon
(74) *Attorney, Agent, or Firm* — Rader, Fishman & Grauer PLLC

(57) ABSTRACT

Exemplary pistons are disclosed, e.g., for an internal combustion engine. An exemplary piston includes a lower part and an upper part, whereby the lower part and the upper part define a circumferential closed cooling gallery. The cooling gallery may be provided with a gallery bottom. The piston may further include a circumferential bar positioned on the gallery bottom, the circumferential bar defining at least one coolant inlet and at least one coolant outlet extending through the bar.

20 Claims, 3 Drawing Sheets

PISTON FOR AN INTERNAL COMBUSTION ENGINE

TECHNICAL FIELD

The present disclosure refers to an exemplary piston for an internal combustion engine. The exemplary piston comprises a lower part and an upper part, whereby the lower part and the upper part constitute a circumferential closed cooling gallery, the cooling gallery being provided with a gallery bottom.

BACKGROUND

A generic piston is for example disclosed in the document WO 2010/009779 A1. This known piston consists of a lower part and an upper part, which are joined together by friction welding. Therefore this piston includes typical friction weld beads. This piston further comprises a circumferential cooling gallery with a gallery bottom, which is equipped with a standpipe. The standpipe projects into the cooling gallery and extends axially downwards on the other. The standpipe is held in its position by the friction weld beads and serves to introduce a coolant into the cooling gallery. However, the manufacturing of such a piston is labor intensive and therefore expensive.

Accordingly, there is a need for an improved generic piston allowing fluid communication into a cooling gallery, while also allowing for simplified, and thus more cost-efficient, manufacturing.

BRIEF DESCRIPTION OF THE DRAWINGS

While the claims are not limited to the illustrated examples, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an embodiment. Further, the specific examples described herein are not intended to be exhaustive or otherwise limiting or restricting to the precise form and configuration shown in the drawings and disclosed in the following detailed description. Exemplary illustrations are described in detail by referring to the drawings, as follows:

DETAILED DESCRIPTION

Figure 1:
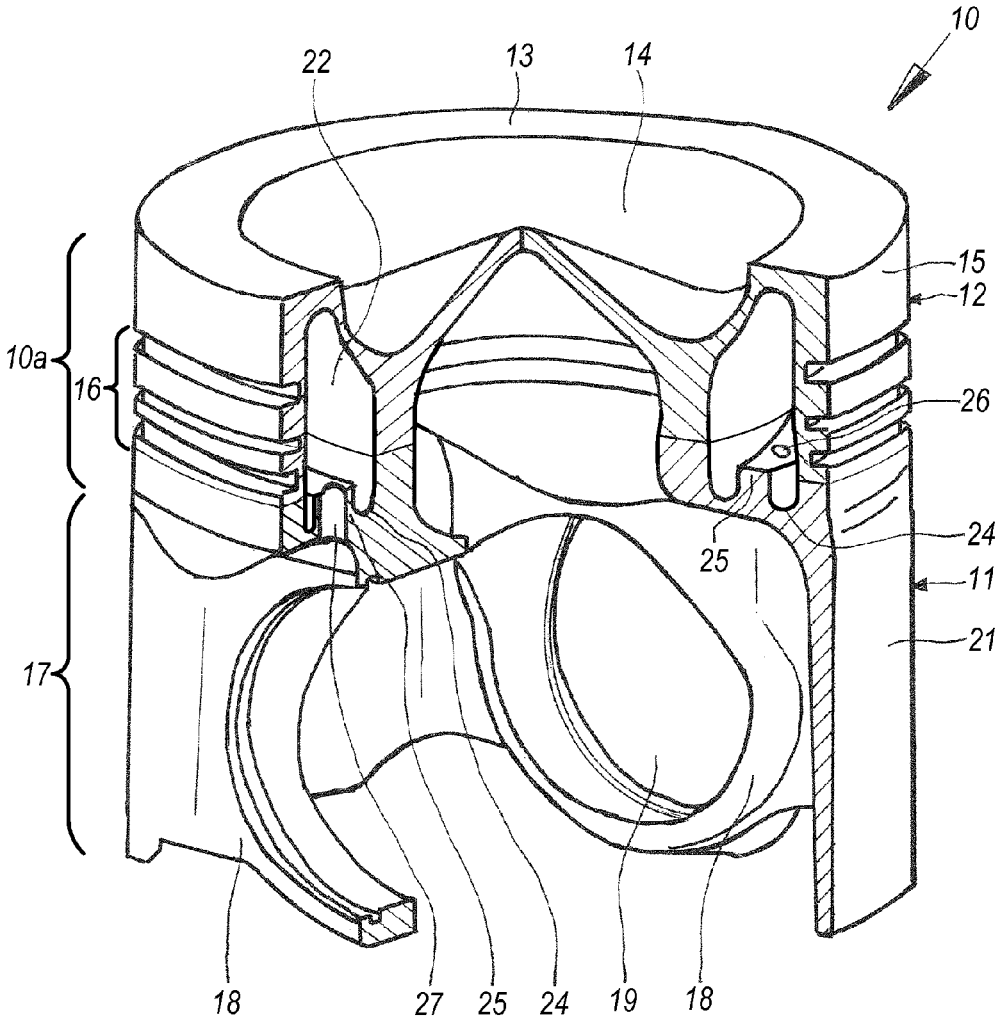
FIG. 1 shows an exemplary illustration of a partially sectioned piston in a perspective view.

Reference in the specification to "an exemplary illustration", an "example" or similar language means that a particular feature, structure, or characteristic described in connection with the exemplary approach is included in at least one illustration. The appearances of the phrase "in an illustration" or similar type language in various places in the specification are not necessarily all referring to the same illustration or example.

Exemplary illustrations are provided herein of a piston, e.g., for an internal combustion engine. An exemplary piston may include a piston head, comprising a piston crown, a circumferential top land, a circumferential ring-receiving part and in the region of the ring-receiving part a circumferential closed cooling gallery. The cooling gallery may include a gallery bottom. The piston skirt may comprise piston pin bosses that define pin bores and may be connected by bearing surfaces. Accordingly, the piston generally includes a lower part, e.g., a skirt, and an upper part, e.g., a crown, both generally cooperating to define the cooling gallery. The lower part or skirt may form at least the gallery bottom of the cooling gallery.

The exemplary piston may further include a circumferential bar that is arranged on the gallery bottom. The circumferential bar may define at least one coolant inlet and at least one coolant outlet. The inlet and/or outlet may extend through the gallery bottom, thereby allowing fluid communication in and/or out of the cooling gallery.

Accordingly, an extra part, e.g., an axially downwards extending standpipe, may be eliminated by forming the exemplary circumferential bar, such as on the gallery bottom. More specifically, at least one coolant inlet and at least one coolant outlet may be directly formed within the circumferential bar. The circumferential bar is completely sufficient to introduce a coolant into the cooling gallery in a well-directed way.

The circumferential bar may be configured to provide a desired filling level of the cooling gallery. For example, the height of the bar may be selected to ensure that an arbitrary minimum filling level of the coolant in the cooling gallery is guaranteed. More specifically, a desired minimum filling level may tend to correspond directly to or in proportion to a height of the circumferential bar adjacent an inlet and/or outlet of the circumferential bar. A height of the circumferential bar may be defined by an absolute measurement, or may be defined in relationship to other piston parameters such as a diameter of the piston. A height of the circumferential bar may affect a desired minimum filling level associated with the cooling gallery both during engine operation, i.e., during the upward stroke and during the downstroke of the piston, respectively, as well when the piston is stationary, e.g., when the engine is not operating. The height of the circumferential bar may also be determined in part by a desired balance between an overall weight of the piston and an overall volume of the cooling gallery, which may be impacted positively and negatively, respectively, as circumferential bar height increases.

As will be described further below, in some exemplary illustrations the coolant holes may be manufactured in a "V-shaped" geometry, with two exits to an interior of a cooling gallery, and a tunnel-type inlet hole leading from outside the gallery. Such a geometry may facilitate division of a cooling jet of a cooling medium received in the inlet hole into both sides of the inner channel, i.e., with one exit leading to each side of the circumferential bar in the cooling gallery, thereby improving a filling ratio and cooling efficiency of the cooling gallery.

Other characteristics of the circumferential bar may also be selected to provide a desired filling level and/or minimum cooling gallery filling level. For example, as will be described further below, the circumferential bar may define various shapes, e.g., rooftop, offset, rectangular, or round shapes to provide a desired cooling gallery configuration and/or filling characteristic. The bar may also be formed with any of a variety of surface structures, for example flat, slanted, textured, etc., to improve flow characteristics of the coolant across these surfaces, thereby improving the cooling performance.

Furthermore, the circumferential bar may contribute to the control of the overall weight of the piston and to balance the upper part and the lower part of the piston. More specifically, the circumferential bar may be reduced in size to remove weight from the lower part, e.g., by thinning the bar or reducing it in height. Alternatively, the circumferential bar may be/thickened or increased in height to add weight to the lower part.

Arranging the exemplary circumferential bar, e.g., on the gallery bottom, may be generally easier and less labor-intensive than introducing a standpipe in an opening provided in the gallery bottom. Particularly, during the manufacturing of the piston, the bar can be constructed as an integrally formed part, which after its arrangement on the gallery bottom, either integrally or as a separate part, is provided with the at least one coolant inlet and the at least one coolant outlet. In one exemplary illustration, the bar may extend around an entire periphery of the piston.

The bar may be formed integrally with the gallery bottom, e.g., by forging or casting the bar integrally with the lower or skirt part. The bar may alternatively be formed as a separate part which is connected with the gallery bottom, for example by welding or by brazing/soldering.

The bar may be positioned on the gallery bottom in a center position of the cooling gallery, or off-center with respect to the width of the gallery bottom. In this way the flow of the coolant can be controlled in order to optimize the cooling performance and to adapt the cooling performance to meet the requirements of each individual case. The bar may be offset radially outwardly with respect to a central axis of the piston.

The diameter of at least one coolant inlet along the circumferential bar may be smaller than the diameter of at least one coolant outlet, so that the outflow of heated coolant is guaranteed and optionally accelerated to ensure the inflow of fresh coolant and to optimize the cooling performance. Furthermore, a passage to/from the cooling gallery along the circumferential bar may be substantially vertical, or may be angled, or may be V-shaped as noted above. In some cases, angling the passage may increase an amount of oil that is forced into the gallery, thereby improving a filling ratio of the cooling gallery. Moreover, the passage may be elongated or funnel-shaped to customize the permissiveness or restrictiveness of the passage to oil or coolant being supplied to the cooling gallery.

The exemplary piston may, in the simplest illustration, be provided with a single coolant inlet and a single coolant outlet, which are positioned diametrically opposite each other, in order to guarantee a controlled inflow and a controlled outflow of the coolant, e.g., by separating the inflow and outflow of coolant radially about the piston.

Figure 2:
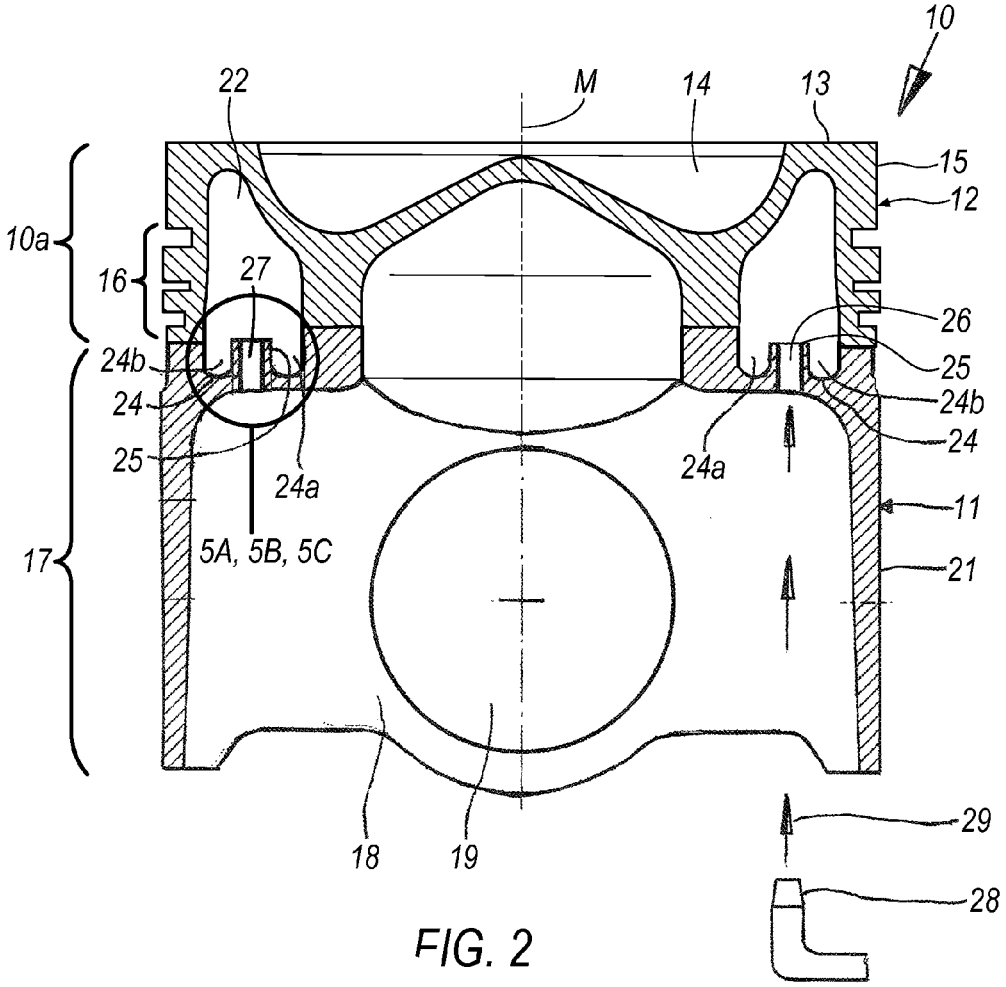
FIG. 2 shows the piston according to FIG. 1 in a longitudinal cross-sectional view.

FIGS. 1 and 2 show an exemplary piston 10. The piston 10 comprises a lower part 11 and an upper part 12. Both parts may be made of any suitable metallic material.

The upper part 12 may include a piston crown 13 having a combustion bowl 14. The upper part 12 is further provided with a circumferential top land 15, and with a circumferential ring-receiving part 16 for receiving piston rings (not shown). The lower part 11 is provided with a piston skirt 17, comprising piston pin bosses 18 that define pin bores 19 for receiving a piston pin (not shown). The lower part 11 is further provided with bearing surfaces 21 defined by the skirt 17. The lower part 11 and the upper part 12 both cooperate to define a circumferential and generally closed cooling gallery 22 having a gallery bottom 24.

In this example, the upper part 12 forms substantially the piston head 10*a* of the piston 10, and the lower part 11 forms substantially the piston skirt 17 of the piston 10. Of course other examples are possible, wherein the lower part 11 may form parts of the piston head 10*a*, for example part of the ring-receiving section 16 or parts of the combustion bowl 14, respectively.

In this exemplary illustration, the lower part 11 and the upper part 12 are joined by welding, e.g., laser welding, friction welding that results in the formation of friction weld beads (not shown), or any other method of joining the lower part 11 and upper part 12 that is convenient. Other methods of joining the lower part 11 and the upper part 12 may be employed.

The upper part 12 and the lower part 11 may be, for example, manufactured by casting or forging. In this example, a gallery bottom 24 is formed during the manufacturing process of the lower part 11. The gallery bottom 24 is provided with a circumferential bar 25 which in this example extends substantially about the entire circumference of the piston. The circumferential bar 25 may be formed integrally with the gallery bottom 24. Subsequently, the bar 25 and the gallery bottom 24 may be provided with a coolant inlet 26 and a coolant outlet 27, which are positioned diametrically opposite each other. The lower part 11 and the upper part 12 may optionally be intermediately machined, joined and optionally finally machined, which results in the finished piston 10.

After the joining of the lower part 11 and the upper part 12, the circumferential bar 25 extends axially into the cooling gallery 22 formed by the lower part 11 and the upper part 12. In this exemplary illustration, the bar 25 is positioned off-center on the gallery bottom 24, with respect to the width of the gallery bottom 24. More specifically, the bar 25 is offset radially outwards referring to a central axis M of the piston 10. Consequently the gallery bottom 24 is divided into a broader inner portion 24*a* and a narrower outer portion 24*b*. The height of the bar 25, calculated from the gallery bottom 24, may be defined in such a way that within the cooling gallery 22 the filling level of the coolant does not fall below a predetermined value. Further, the height of the circumferential bar 25 may affect the filling level of the coolant when the piston 10 is moving during engine operation, i.e., during the upward stroke and during the downstroke of the piston 10, as well as when the piston 10 is stationary. More specifically, an increase in a height of the bar 25, e.g., relative to the gallery bottom 24, may increase an amount of coolant retained in the cooling gallery 22 during operation. In another exemplary illustration, a position or height of the inlet hole 26 of the circumferential bar 25 may also influence a filling level of the coolant when the piston 10 is in operation. For example, a greater height of the inlet hole 26 with respect to the gallery bottom 24 may increase an amount of coolant retained within the cooling gallery 22 during operation.

Figure 3:
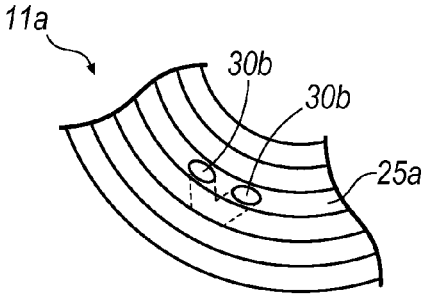
FIG. 3 shows an exemplary illustration of a partially sectioned lower part or skirt of a piston in a perspective view.
Figure 4:
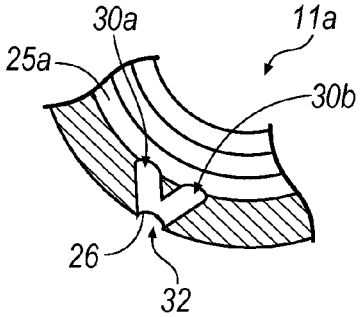
FIG. 4 shows a partial cutaway view of the exemplary illustration of the lower part of FIG. 3.

Turning now to FIGS. 3 and 4, an exemplary illustration of a piston lower part 11*a* having coolant holes 26*a* that have one or more angled passages and/or a "V-shaped" geometry is shown. The holes 26*a* may have two exits or apertures 30*a*, 30*b* on an inside and a tunnel-type inlet hole or aperture 32. The two apertures 30*a*, 30*b* may thereby cooperate to form two passages that are angled, e.g., with respect to an axis of the piston 10, leading into the cooling gallery 22 (not shown in FIGS. 3 and 4) that define a generally "V-shaped" configuration. Accordingly, a coolant flow entering the inlet aperture 32 (direction of arrows shown in FIG. 4) may generally be split into two components entering the cooling gallery 22 by way of the two apertures 30*a*, 30*b*. The single inlet 32 and dual outlets 30*a*, 30*b* may thereby facilitate division of the incoming cooling medium flow received in the inlet 32 to either side of the inner channel, i.e., with one exit leading to each side of the circumferential bar 25. A division of the incoming coolant flow may improve a filling ratio of the cooling gallery 22 (not shown in FIGS. 3 and 4) and an overall cooling efficiency of the piston 10 (not shown in FIGS. 3 and 4).

The diameter of the coolant inlet 26 may be smaller than the diameter of the coolant outlet 27. In this way, heated coolant may be allowed to relatively rapidly leave the cooling gallery 22 by way of the outlet 27 and be replaced by fresh coolant entering by way of the inlet 26. Additionally, a ratio of a size of the coolant inlet 26 to a size of the coolant outlet 27 may also influence a filling ratio of the cooling gallery 22. For example, where a coolant outlet 27 is smaller in cross-sectional area than the coolant inlet 26, coolant may be more likely to accumulate in larger amounts within the cooling gallery 22 than for examples where the coolant outlet 27 is the same size or larger in cross-sectional area than the coolant inlet 26. Accordingly, a more restrictive outlet 27 in relation to the inlet 26 may increase retention of coolant within the cooling gallery 22, as the inlet 26 may be generally more permissive of coolant flowing into the cooling gallery 22, while the outlet 27 is more restrictive of coolant flowing back out of the cooling gallery 22. Moreover, the cooling inlet 26 and/or outlet 27 may be configured to be more or less restrictive to coolant flow into and out of the cooling gallery 22 in any manner that is convenient, in addition to the above-mentioned adjustments to the cross-sectional areas of the inlet 26 and/or outlet 27. Merely as an example, the inlet 26 and/or outlet 27 may define a cross-section that varies along the inlet 26 and/or outlet 27. In one exemplary illustration, the inlet 26 and/or the outlet 27 may be funnel shaped, e.g., by defining a cross-sectional area that varies along the inlet 26 or outlet 27. In another exemplary illustration, the inlet 26 and/or outlet 27 may be elongated along portions or the entirety of the inlet 26 and/or outlet 27.

As noted above, the circumferential bar 25 may define any variety of shapes to provide a desired cooling gallery configuration and/or filling characteristic. Moreover, the various shapes and configurations may generally allow further customization of a cooling effect of the cooling gallery 22 and/or performance of a piston 10, as further described below.

Figure 5A:
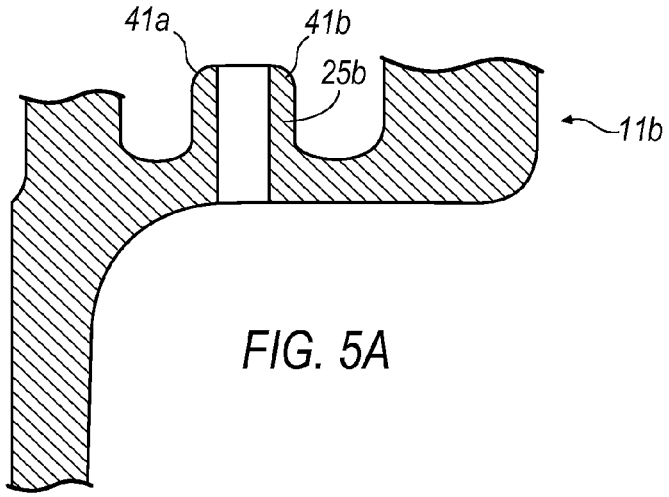
FIG. 5A illustrates a lower part or skirt of a piston having a circumferential bar with a rounded shape, according to one exemplary illustration.

In one exemplary illustration shown in FIG. 5A, the circumferential bar 25 may define a generally rounded shape along an upper surface of the circumferential bar 25. The rounded shape may include corner portions 41*a*, 41*b* that define a curving surface within the cooling gallery that minimizes stresses along the curved surfaces, e.g., residual stresses in the circumferential bar 25*b* from a forming process associated with the circumferential bar 25*b*.

Figure 5B:
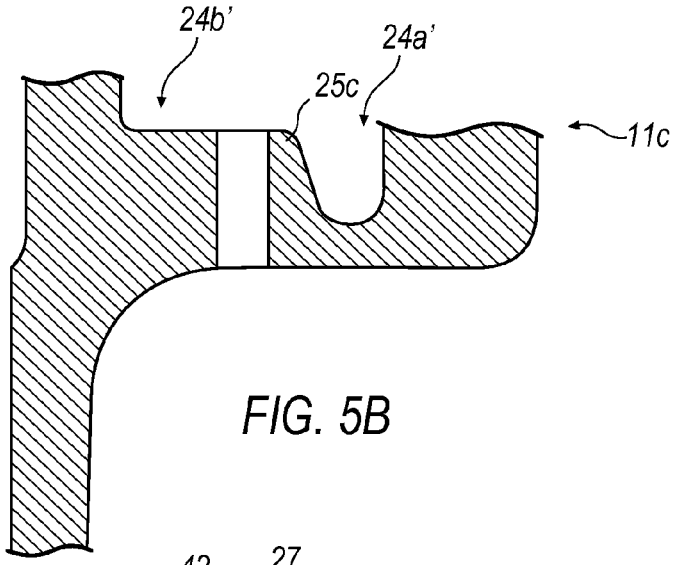
FIG. 5B illustrates a lower part or skirt of a piston having a circumferential bar with an offset shape, according to one exemplary illustration.

In another example shown in FIG. 5B, the circumferential bar 25 may define an offset shape. An offset shape may allow for greater cooling effect in areas where more cooling gallery area is provided. More specifically, in the example illustrated in FIG. 5B, coolant may tend to accumulate on a radially inner side 24*a*' of the circumferential bar 25, at least to a greater extent than a radially outer side 24*b*', as a result of the offset shape of the circumferential bar 25, which results in a greater portion of the volume of the cooling gallery 22 being disposed on the radially inner side 24*a*' of the circumferential bar 25.

Figure 5C:
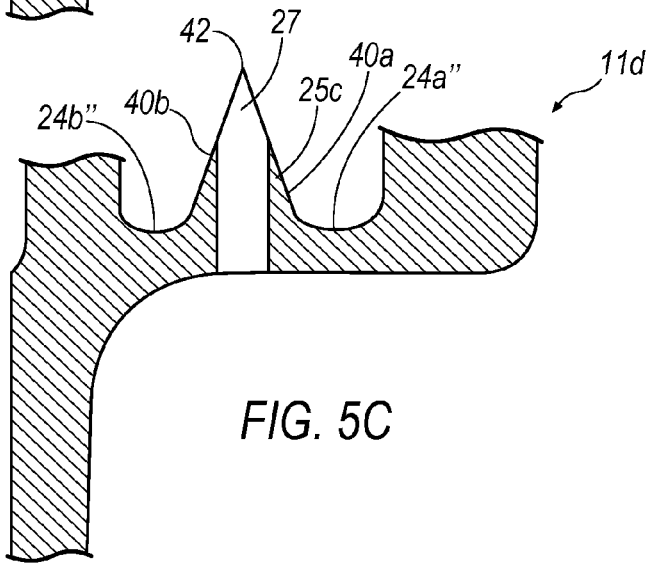
FIG. 5C illustrates a lower part or skirt of a piston having a circumferential bar with a rooftop shape, according to one exemplary illustration.

In another exemplary illustration, the circumferential bar 25 may define a "rooftop" shape, as shown in FIG. 5C. In this example, the sloping sides 40*a*, 40*b* of the circumferential bar 25 meet at an apex 42, which is generally centered with respect to the circumferential bar 25. The sloping sides 40*a*, 40*b* may promote flow of coolant away from the apex 42. Additionally, a greater height of the apex 42, e.g., relative to a gallery bottom on a radially inner side 24*a*" and/or a gallery bottom on a radially outer side 24*b*", may prevent coolant from traversing the circumferential bar 25 to a greater degree than, for example, a circumferential bar where the height of the circumferential bar 25 is less than the axial height within the gallery of the apex 42. Moreover, a greater height of the apex 42 may increase surface area presented along the circumferential bar 25*c*, thereby improving the degree of heat transfer between the circumferential bar 25*c* and oil or other coolant in the gallery.

The coolant, e.g., engine oil, may be injected or otherwise forced through the coolant inlet 26 into the cooling gallery 22, in the direction of the arrows 29, for example by a nozzle 28. Accordingly, the circumferential bar 25 may generally replace additional piston parts, e.g., a standpipe, thereby simplifying manufacture of the piston 10.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A piston for an internal combustion engine, comprising:

a lower part;

an upper part, wherein the lower part and the upper part cooperate to define at least a portion of a generally closed circumferential cooling gallery, the cooling gallery being defined in part by a gallery bottom; and a circumferential bar positioned on the gallery bottom, the circumferential bar defining at least one coolant inlet and at least one coolant outlet extending through the gallery bottom;

wherein at least one of the at least one coolant inlet and the at least one coolant outlet includes a first aperture and a passage extending therefreom, the passage leading to a plurality of additional apertures on an interior of the cooling gallery, wherein the plurality of additional apertures are spaced away from the first aperture such that the passage is a generally V-shaped passage.

2. The piston according to claim 1, wherein the bar is formed integrally with the gallery bottom.

3. The piston according to claim 1, wherein the bar is formed as a separate part which is connected with the gallery bottom.

4. The piston according to claim 1, wherein the bar is positioned on the gallery bottom off-center with respect to a width of the gallery bottom.

5. The piston according to claim 1, wherein the bar is offset radially outwards with respect to a central axis of the piston.

6. The piston according to claim 1, wherein a first diameter of at least one coolant inlet is smaller than a second diameter of at least one coolant outlet.

7. The piston according to claim 1, wherein a single coolant inlet and a single coolant outlet are provided.

8. The piston according to claim 7, wherein the single coolant inlet and single coolant outlet are positioned diametrically opposite each other with respect to the piston.

9. The piston according to claim 1, wherein the circumferential bar extends about substantially an entire periphery of the piston.

10. The piston according to claim 1, wherein at least one of the additional apertures is positioned relative to the first aperture to form an angled passage extending into the cooling gallery.

11. The piston according to claim 1, wherein the circumferential bar defines opposing rounded portions.

12. The piston according to claim 1, wherein the circumferential bar extends annularly about at least a portion of the periphery of the piston.

13. The piston according to claim 1, wherein the passage is configured to divide a coolant flow through the passage between the two outlet apertures.

14. The piston according to claim 1, wherein the at least one of the at least one coolant inlet and the at least one coolant outlet includes two passages, wherein the two passages are angled with respect to an axis of the piston.

15. The piston according to claim 1, wherein the passage is V-shaped.

16. A piston for an internal combustion engine, comprising:

a piston head, including a piston crown, a circumferential top land, and a circumferential ring-receiving part; and a piston skirt, including piston pin bosses defining pin bores, the piston pin bosses being connected by bearing surfaces, the skirt cooperating with the piston head to define a circumferential closed cooling gallery adjacent the ring-receiving part, the cooling gallery including a gallery bottom;

wherein the piston includes a lower part and an upper part, both cooperating to at least partially form the cooling gallery, the lower part forming at least the gallery bottom of the cooling gallery; and wherein a circumferential bar is arranged on the gallery bottom, at least one coolant inlet and at least one coolant outlet being defined by the circumferential bar, each of the at least one coolant inlet and at least one coolant outlet extending through the gallery bottom; and wherein at least one of the at least one coolant inlet and the at least one coolant outlet includes a first aperture and a passage extending therefreom, the passage leading to a plurality of additional apertures on an interior of the cooling gallery, wherein the plurality of additional apertures are spaced away from the first aperture such that the passage is a generally V-shaped passage.

17. The piston according to claim 16, wherein the bar is formed integrally with the gallery bottom.

18. The piston according to claim 16, wherein the bar is positioned on the gallery bottom off-center with respect to a width of the gallery bottom.

19. The piston according to claim 16, wherein the circumferential bar extends about substantially an entire periphery of the piston.

20. A piston for an internal combustion engine, comprising:

a lower part;

an upper part, wherein the lower part and the upper part cooperate to define at least a portion of a generally closed circumferential cooling gallery, the cooling gallery being defined in part by a gallery bottom; and a circumferential bar positioned on the gallery bottom, the circumferential bar defining a coolant inlet extending through the gallery bottom;

wherein the coolant inlet includes a first aperture and a passage extending therefreom, the passage leading to a plurality of additional apertures on an interior of the cooling gallery, wherein the plurality of additional apertures are spaced away from the first aperture such that the passage is a generally V-shaped passage.

* * * * *

UNITED STATES PATENT AND TRADEMARK OFFICE

CERTIFICATE OF CORRECTION

PATENT NO. : 8,739,755 B2
APPLICATION NO. : 13/279671
DATED : June 3, 2014
INVENTOR(S) : Stan et al.

It is certified that error appears in the above-identified patent and that said Letters Patent is hereby corrected as shown below:

On the Title page, item (75), the third inventor's name is listed as Tony Daivd Cimbalik, Peoria, IL (US)

It should read as follows:

Tony David Cimbalik, Peoria, IL (US)

In the Claims:

At column 7, claim number 1, line number 3, delete "therefreom" and insert -- therefrom --.

At column 8, claim number 16, line number 20, delete "therefreom" and insert -- therefrom --.

At column 8, claim number 20, line number 44, delete "therefreom" and insert -- therefrom --.

Signed and Sealed this
Twenty-third Day of December, 2014

Michelle K. Lee

Michelle K. Lee
*Deputy Director of the United States Patent and Trademark Office*